United States Patent [19]

Tseng

[11] Patent Number: 4,460,101

[45] Date of Patent: Jul. 17, 1984

[54] TORTUOUS PASSAGE COVER FOR FLEXIBLE LIQUID CONTAINER

[76] Inventor: Bang-Tsai Tseng, No. 118, Lane 526, Ta-Tung Rd., Tainan City, Taiwan

[21] Appl. No.: 454,242

[22] Filed: Dec. 28, 1982

[51] Int. Cl.[3] ..... B65D 51/24

[52] U.S. Cl. ..... 215/307; 220/374; 220/90.4

[58] Field of Search ..... 215/307; 220/90.4, 374; 222/454

[56] References Cited

U.S. PATENT DOCUMENTS 2,456,989 12/1948 Polcyn ..... 220/90.4
3,385,467 5/1968 Lindenberg ..... 220/374

FOREIGN PATENT DOCUMENTS 951553 3/1964 United Kingdom ..... 215/307

*Primary Examiner*—Donald F. Norton
*Attorney, Agent, or Firm*—Browdy and Neimark

[57] ABSTRACT

A tortuous passage cover for flexible liquid container comprises an upper cover body having an outlet in the central area, and an upper joint ring and a lower joint ring integrally formed thereto; and a lower cover body having a cylindrical protrusion and a plurality of projecting rings and outlet openings formed thereto closely linked to the bottom portion of the upper cover body in defining a tortuous passage channel therein and communicating with the outlet of the upper cover body and the outlet openings of the lower cover body. Therefore, by means of the tortuous resistance offered by the tortuous passage channel, the liquor contained in the container furnished with this cover will not flow out when the container is accidently tipped over.

5 Claims, 3 Drawing Figures

TORTUOUS PASSAGE COVER FOR FLEXIBLE LIQUID CONTAINER

BACKGROUND OF THE INVENTION

This invention relates to a tortuous passage cover for being fixed on the mouth portion of a flexible liquid container for preventing the liquor therein from spilling out when the container is accidently tipped over.

Liquid containers are usually made of glass or plastics for containing sauce, vegetable oil, lubricant, shampoo, tonic, etc., for daily use. This invention is adaptable only to the liquid containers made of plastics, which is flexible and can be pressed for squeezing out the liquid therefrom.

Conventionally, covers for liquid container are usually made in a close-top type for being tightly coupled with the mouth of the container for preventing the liquid from spilling out therefrom. Therefore, it is very inconvenient for the user to open and close the cover on the mouth of the liquid container. Further than this, the defects are that: (1) when the cover is removed for pouring out the liquid, the user usually cannot control the flowing amount of the liquid from the container, often resulting in excessive consuming of the materal; and (2) when the cover is not tightly engaged with the mouth of the container, once the container is accidently tipped over, liquid contained therein will spill, not only causing unnecessary waste, but also potentially contaminating other material with the liquid, and perhaps in a hazardous manner.

SUMMARY OF THE INVENTION

It is accordingly a primary object of this invention to provide a tortuous passage cover for liquid container to overcome the defects noted above so that the user can control the flowing amount of the liquid without removing the cover, and the liquid will also not spill therefrom when the container with this cover is tipped over.

This and other objects are achieved by providing a tortuous passage cover for liquid container, which cover comprises an upper cover body having an outlet in the central area, an upper joint ring and a lower joint ring integrally formed thereto; and a lower cover body with a plurality of projecting rings and outlet openings formed therein closely linked to the bottom of the upper cover body in defining a tortuous passage channel therein and communicating with the outlet of the upper cover body and the outlet openings of the lower cover body. When this cover is fixed on the mouth of the liquid container, the flowing amount can easily be controlled by squeezing the container without removing the cover, and, moreover, the liquid contained therein will not spill when the container is accidently tipped over.

These objects and advantages of this invention will become apparent from the following description of a preferred embodiment when read in conjunction with the accompanying drawings.

DETAILED DESCRIPTION OF THE PREFERRED EMBODIMENT

Figure 1:
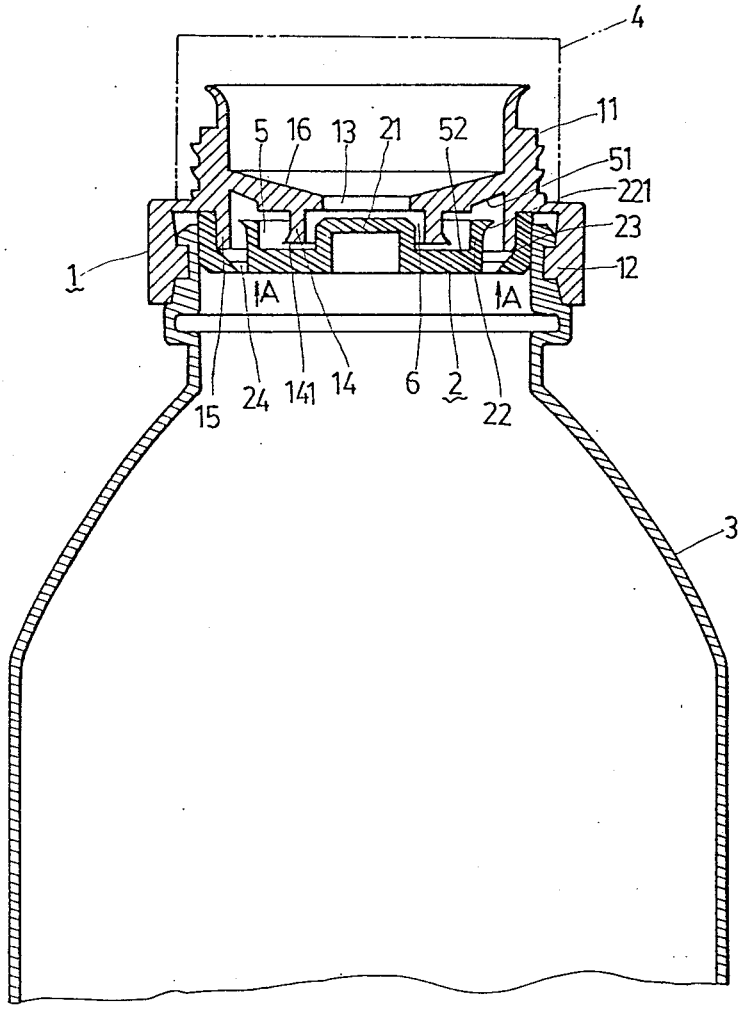
FIG. 1 is a longitudinal sectional view of a preferred embodiment of a tortuous passage cover for liquid container according to this invention.

Referring to FIG. 1, there is shown a structure of a preferred embodiment of a tortuous passage cover for flexible liquid container according to this invention, which comprises an upper cover body 1 and a lower cover body 2 closely linked to the bottom portion of the upper cover body 1, which includes an outlet 13 formed in the central area, an upper joint ring 11 and a lower joint ring 12 integrally formed thereto for being tightly coupled with the mouth portion of the liquid container body 3 at the lower part and with a bottle cover 4 at the upper part through a scarfing or screwing connection.

Figure 2:
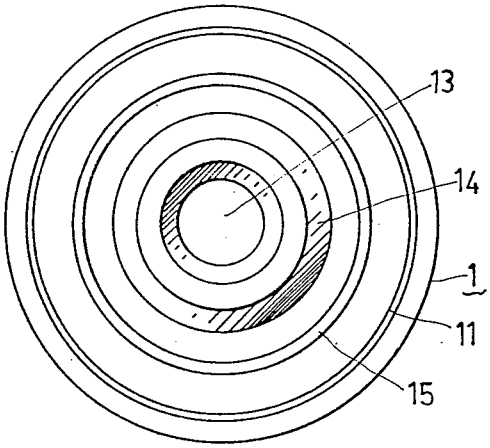
FIG. 2 is an enlarged bottom view of the upper cover body shown in FIG. 1.

As shown in FIGS. 1 and 2, the upper cover body 1 includes an inner annular protrusion 14 and an outer annular protrusion 15 symmetrically formed on the bottom side along the periphery of the outlet 13, wherein the inner annular protrusion 14 has an outward flange 141 extending at one side thereof.

Figure 3:
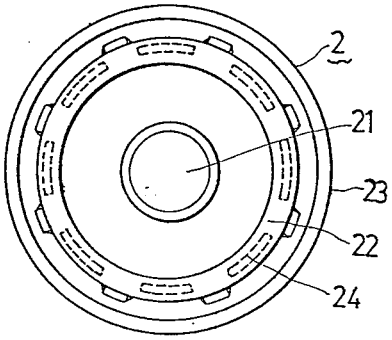
FIG. 3 is an enlarged top view of the lower cover body shown in FIG. 1.

Referring to FIGS. 1 and 3, the lower cover body 2 includes a cylindrical protrusion 21 corresponding to the outlet 13 and situated within the space defined by the inner annular protrusion 14 with a curved passage channel 6 formed therein; a flanged ring 22 having an outward flange 221 extending at one side thereof located within the space defined by the inner annular protrusion 14 and the outer annular protrusion 15 with a curved passage channel 5 formed therein and communicating with the passage channel 6; a projecting boundary ring 23 closely engaged to the outer wall of the annular protrusion 15 defining an annular space therein with the lower joint ring 12 for being scarfed to the mouth portion of the liquid container 3; and a plurality of outlet openings 24 formed in the bottom portion between the flanged ring 22 and the projecting boundary ring 23 in communicating with the passage channel 5. With the combination of the upper cover body 1 and the lower cover body 2, the passage channels 5 and 6, together with the terminal walls 51, 52 and the outlet openings 24, constitute a tortuous and communicative passage channel therein for effecting check action to the liquor thereof. Therefore, when the container 3 is accidently tipped over, the liquor contained therein will initially produce an impulsive force upon the bottom of the lower cover body 2 (as shown by the arrowheads A), and press the liquor into the tortuous passage channels 5 and 6 through the outlet openings 24. However, the impulsive force of the liquor in the tortuous passage channels 5 and 6 will be successively impinged upon the outward flanges 141 and 221 as well as upon the terminal walls 51 and 52 of the passage channel 5, so that, the impulsive force thereof will be completely dissipated therein through the tortuous resistance offered by the tortuous passage channels 5 and 6. In addition, as an atmospheric pressure also exists over the outlet 13, the liquid coming through the passage channel 5 cannot pour out through the passage channel 6 thereof.

In dispensing the liquid container 3, the user can easily control the flowing amount of the liquid simply by squeezing the container 3 with his hand as required. In this way, as the pressure applied to the container 3 by the user's hand is greater that the tortuous resistance of the passage channels 5 and 6 as well as the atmospheric pressure over the outlet 13, the liquid will surely come out of the outlet 13 as long as the pressure from the user's hand remains.

In addition, the preferred embodiment of this invention can be provided with a separate cover (as shown by the dotted line 4 in FIG. (1) for keeping the outlet 13 in closed condition. Moreover, for facilitating the flowing control of the liquor thereof, the outward periphery of the outlet 13 has a sloped surface 16 for liquid dispensing purpose, so that, after dispensing, the remnant of the liquid on the sloped surface 16 will automatically flow back into the container along with the recovery of container 3 without any spillage.

While a preferred embodiment has been chosen to illustrate the invention, it will be understood by those skilled in the art that various changes and modifications can be made therein without departing from the scope of the invention as defined in the appended claims.

What is claimed is:

1. A tortuous passage cover for a flexible container comprising an upper cover body and a lower cover body defining a tortuous passage therebetween, said upper cover body having a top wall and a downwardly extending surrounding annular wall and including:

(a) a lower joint ring formed in the outer periphery of the downwardly extending portion of the upper cover body annular wall sealingly engageable with the top of the container;

(b) a central outlet for the liquid within the container defined by the top wall of the upper cover body; and (c) outer and inner spaced annular rings depending from the inner surface of the top wall coaxially with the central outlet;

said lower cover body having a bottom wall and a surrounding upwardly extending annular wall frictionally engageable with the outer coaxial annular ring of the upper cover body for retaining the upper and lower cover body together, and including (d) at least one outwardly flanged annular ring inwardly spaced from and coaxial with the surrounding annular wall of the lower cover body and extending upwardly from the inner surface of the bottom wall of the lower cover body into the space between the coaxial annular rings of the upper cover body;

(e) a cylindrical protrusion spaced from and coaxial with the flanged annular ring extending upwardly from the inner surface of the bottom wall of the lower cover body into the space defined by the inner annular ring of the upper cover body, and conforming to the cross-sectional dimensions of the outlet;

(f) a plurality of annularly disposed inlet apertures defined by the portion of the bottom wall of the lower cover body between the surrounding annular wall and the flanged annular ring for passage of liquid from the container; said annular rings and cylindrical protrusion defining a tortuous passage between the upper and lower cover bodies communicating said inlets with said outlet for tortuous passage of liquid in the container through the inlet apertures to the central outlet so that gravitational forces acting on liquid in the container when the container is tilted or inverted are insufficient to move the liquid through the tortuous passage.

2. The tortuous passage cover of claim 1, further including an upper joint ring formed in the outer periphery of the upper cover body annular wall and a lid for the cover sealingly engageable with the upper joint ring.

3. The tortuous passage cover of claim 2, wherein the annular wall of the upper cover body includes an upwardly-extending portion, and the upper joint ring is formed on the outer periphery of this portion.

4. The tortuous passage cover of claim 1, wherein the top wall of the upper cover body has an inwardly sloping surface extending towards the outlet for guiding liquid on the top wall into the container in upright position.

5. The tortuous passage cover of claim 1, wherein the inner annular ring of the upper cover body is outwardly flanged.

* * * * *